United States Patent [19]

Aiello

[11] Patent Number: 4,462,654

[45] Date of Patent: Jul. 31, 1984

[54] ELECTRICAL CONNECTOR HOUSING WITH INTEGRAL LATCH

[75] Inventor: Richard E. Aiello, East Petersburg, Pa.

[73] Assignee: AMP Incorporated, Harrisburg, Pa.

[21] Appl. No.: 464,448

[22] Filed: Feb. 7, 1983

[51] Int. Cl.[3] ..... H01R 13/627

[52] U.S. Cl. ..... 339/91 R

[58] Field of Search ..... 339/91 R

[56] References Cited

U.S. PATENT DOCUMENTS

| | | | |
|---|---|---|---|
| 3,399,374 | 8/1968 | Pauza et al. | 339/91 R |
| 3,569,909 | 3/1971 | Garver | 339/91 R |
| 3,688,243 | 8/1972 | Yamada et al. | 339/91 R |
| 3,753,212 | 8/1973 | Yamada et al. | 339/91 R |
| 4,310,211 | 1/1982 | Bunnell et al. | 339/91 R |

FOREIGN PATENT DOCUMENTS

| | | | |
|---|---|---|---|
| 1500722 | 2/1978 | United Kingdom | 339/91 R |

*Primary Examiner*—John McQuade

*Attorney, Agent, or Firm*—Robert W. J. Usher

[57] ABSTRACT

An electrical connector housing in which a latch member comprises a lever arm having front and rear ends and integrally joined adjacent the rear end by a resilient web to a side wall of a terminal receiving body to provide a relatively long latch portion with a latching eye adjacent the front end and a shorter, release portion. Anti-overstress flanges depend in parallel relation from lateral edge portions of the release portion in planes beyond and adjacent opposite lateral edges of the side wall aligned for engagement with lugs on adjacent faces of the body enabling the electrical connector housing to be moulded without a requirement for side core pins.

4 Claims, 7 Drawing Figures

ELECTRICAL CONNECTOR HOUSING WITH INTEGRAL LATCH

The invention relates to an electrical connector housing having a latch member integrally formed with a terminal receiving body portion of the housing.

For many years, electrical connector housings have been manufactured as one-piece plastics mouldings with latch members integrally formed with terminal receiving body portions in the interests of simplicity with economy of manufacture and compactness.

In one well known electrical connector housing, the latch member comprises a lever arm integrally joined intermediate its ends to a side wall of the housing by a resilient web for pivotal movement between a release and a latching position, a latch portion of the lever arm extending forwardly of the web to protrude from a mating face of the housing and a finger engageable release portion of the lever arm extending rearwardly of the web and overlying the side wall. The web is located substantially midway along the length of the lever arm so that the latch and release portions are of equal length. Overstress stops having the form of longitudinal ribs are formed on a face of the release portions adjacent the side wall for engagement with the side wall on depressing the release portion towards the side wall to release the latch.

In a more specific form of the prior connector housing, the latch portion is formed centrally with a latch eye and there are two such webs located in lateral planes on respective opposite sides of the latch eye, the ribs being aligned with the webs. The latch portion containing the latch eye is located in a plane displaced below a plane containing the release portion. This particular configuration enables the latch lever arm to be moulded in a straight action mould without a requirement for expensive side core pins to form the eye as a mould core pin can extend from the rear in the plane of the latch portion between mould material forming the webs into material forming the latch portion to form the eye in cooperation with a suitably shaped core pin extending rearwardly from the front of the mould.

In order to satisfy both the requirements to provide a sturdy latch and a compact structure, the webs together with the eye and the consequent core admitting aperture between the webs extend for the entire width of the side walls.

However, in some applications where repeated latching and release of the connector housing is required, the latch member has proven unreliable as a result of excessive strain and eventual failure of the webs. It is desirable, therefore, to reduce the degree of flexure and therefore the stress imposed on the webs. At the same time, the environment of intended use or existing industry standards, precludes any modification of the lever arm which increases its overall length or increases significantly the external dimensions due to severe space restrictions in the particular electrical equipment.

According to the invention, the above-described connector housing is modified in that the webs are located adjacent the rear of the lever arm and the overstress stops comprise flanges depending laterally from the release portion in parallel planes beyond and adjacent lateral edges of the side wall, anti-overstress lugs being provided on respective opposite faces of the body which extend from the lateral edges of the side wall in alignment with the flanges.

The connector according to the invention, enjoys greatly improved reliability stress on the webs during unlatching is less as a result of the increased effective length of the latch portion (and consequential decrease in angular flexure of the webs) while engagement of the flanges and lugs prevent overstress.

Furthermore, the connector housing can still be manufactured using the simple moulding technique described above avoiding any substantial increase in manufacturing cost.

An example of an electrical connector housing according to the invention will now be described with reference to the accompanying drawings in which.

Figure 1:
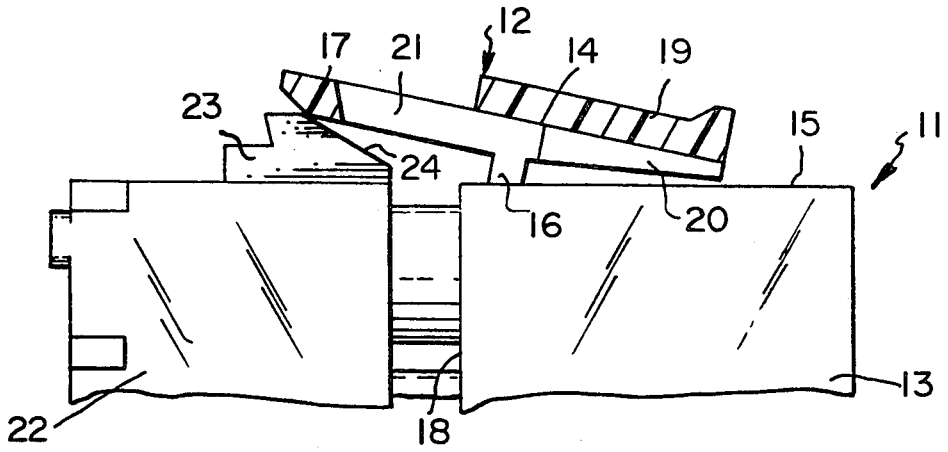
FIG. 1 PRIOR ART
FIG. 1 is a fragmentary elevational view partly in cross-section of a prior connector housing in a partially mated condition with a connector having a complimentary latch.
Figure 2:
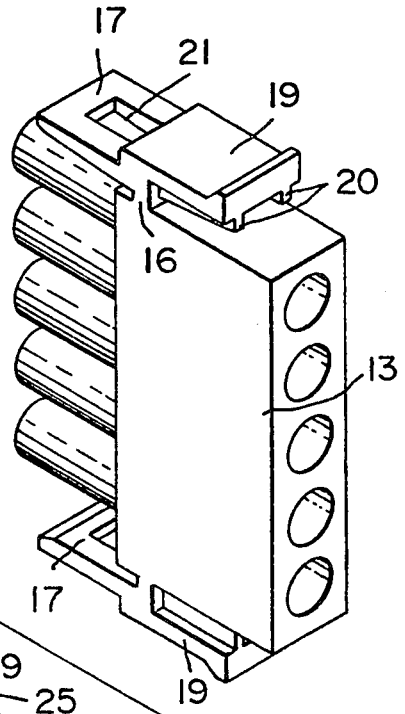
FIG. 2 PRIOR ART
FIG. 2 is a perspective view of the rear of the prior connector housing of FIG. 1.
Figure 3:
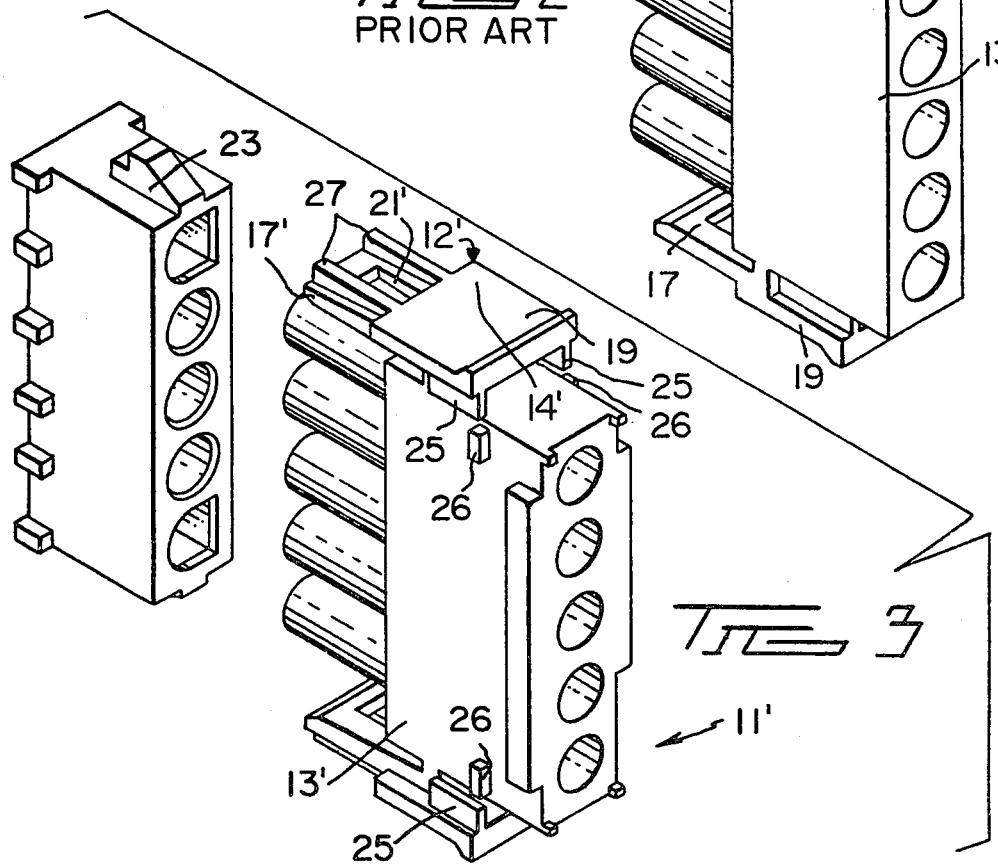
FIG. 3 is a perspective view of a connector housing according to the invention aligned for mating with a complimentary connector.
Figure 4:
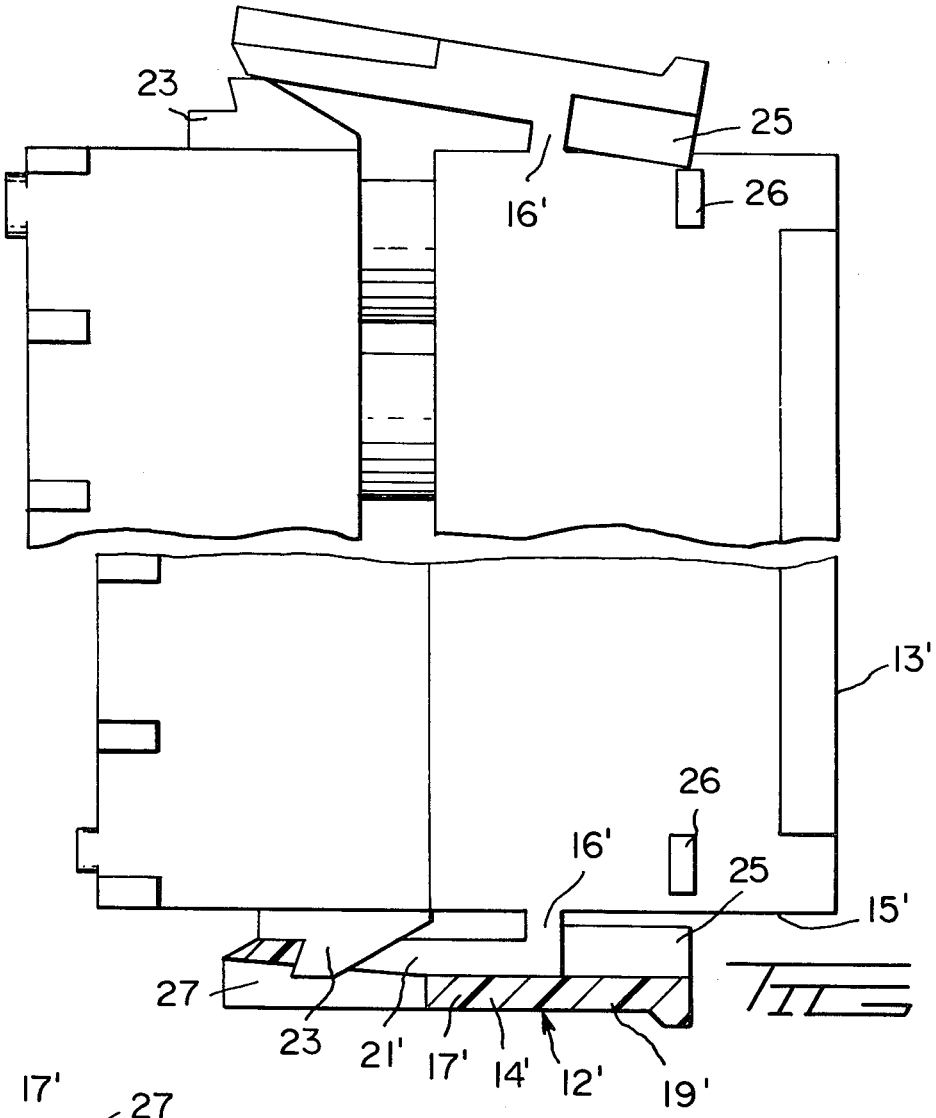
FIG. 4 is a split elevational view of the connector housing of FIG. 3 with the latch members in release and latching positions.
Figure 5:
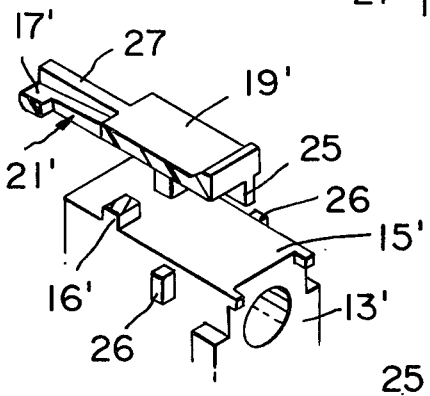
FIG. 5 is a fragmentary, perspective view of the latching member of the connector housing according to the invention; and, FIGS. 6 and 7 are fragmentary front and rear elevational views of the connector housing of the invention, respectively.
Figure 6:
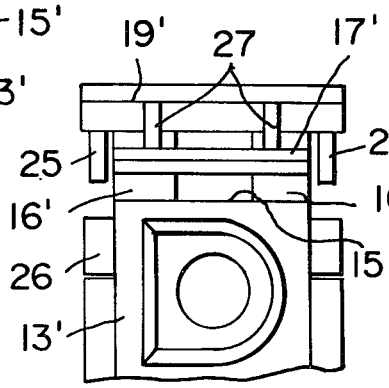
Figure 7:
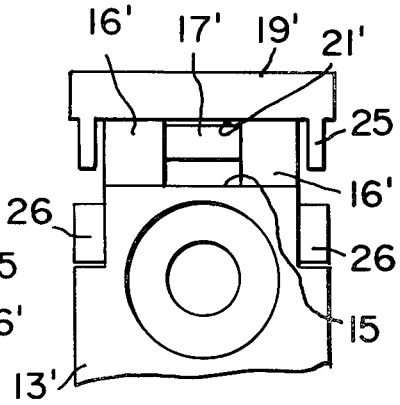

As shown particularly in FIGS. 1 and 2, a connector housing 11 according to the prior art is moulded in one piece of plastics material and comprises a latch member 12 and a terminal receiving body 13 of rectangular section having a side wall 15. The latch member comprises a lever arm 14 integrally joined midway along its length to a side wall of the body 13 by resilient webs 16 for pivotal movement about the webs between release and latching positions. A latch portion 17 of the lever arm extends forwardly of the web to protrude from a mating face 18 of the housing and a finger-engageable release portion 19 of the lever arm extends rearwardly of the webs and overlies the entire width of the side wall. Overstress stops 20 having the form of longitudinal ribs are formed on a lower face of the release portion adjacent the side wall in alignment with and extending to the junction of the lever arm and the webs with which they are integral.

The latch portion 17 is formed centrally with a latch eye 21 aligned between the webs so that the webs are located in lateral planes on respective opposite sides of the latch eye. The latch eye is defined by a portion of material displaced below a plane containing the release portion.

As will be readily understood, the connector housing can be latched to a complimentary housing 22 having a latch 23 with a lead-in ramp surface 24 by simply advancing the connector housings together so that a chamfered leading end of the latch portion rides over the ramp surface with consequent resilient deflection of the webs until the latch is received in the eye. Release of the latch is achieved simply by depression of the release portion, engagement of the ribs with the face of the side wall preventing overstress of the webs.

The connector housing 11' according to the invention shown in FIGS. 2 to 7 is generally similar to the prior connector housing and similar parts are indicated by primed reference numerals.

A latch member 12' comprises a lever arm 14' having front and rear ends integrally joined by a resilient web 16' to a body 13', but unlike the prior connector housing, the web 16' is located adjacent a rear end of the lever arm to provide a relatively long latch portion 17'. Overstress stops comprise flanges 25 depending in parallel relation from lateral edge portions of the release portion which extends laterally beyond the side wall 15' so that the flanges lie in parallel planes beyond and adjacent opposite lateral edges of the side wall. Lugs 26 are formed on respective opposite faces of the housing body which extend from the lateral edges of the side wall in alignment with the flanges 25.

As in the prior connector, eye 21' is defined adjacent a front end by material located in a plane displaced below the plane of the release portion and the webs together with the eye extend laterally for the entire width of the side wall. A pair of stiffening ribs 27 extend in parallel relation along the latch portion on respective opposite sides of the eye portion.

The latching and release operations are performed in a similar fashion to the prior art. However, the extended length of the latch portion produces less strain of the hinges for a given angular displacement of the latch portion than in the prior connector design having a lever arm of the same length. The location of the flanges outside the lateral width of the side wall enables them to be of increased height when compared with the overstress preventing ribs of the prior connector (to fulfill the requirement for decreased displacement of the release portion) without a requirement for them to be integral with the webs obviating any consequential loss of web flexibility.

It will be noted that, as with the prior connector housing, the connector housing of the invention can be moulded using a relatively simple and inexpensive technique without a requirement for side core pins.

I claim:

1. An electrical connector housing moulded in one piece of plastics material comprising a latch member and a terminal receiving body, the latch member comprising a lever arm integrally joined intermediate its ends to a side wall of the body by a resilient web for pivoted movement between release and latching positions, a latch portion of the lever arm extending forwardly of the web to protrude from a mating face of the housing and a finger-engageable release portion of the lever arm extending rearwardly of the web and overlying the entire width of the side wall, stop means being provided on the release portion operative to prevent the release portion being pivoted towards the side wall beyond the release position, in which connector the web is located adjacent the rear of the lever arm and the stop means comprises flanges depending from the release portion in parallel planes beyond and adjacent opposite lateral edges of the side wall and lugs formed on respective opposite faces of the housing body which extend from the lateral edges of the side wall aligned for engagement with the respective flanges to prevent overstress.

2. An electrical connector housing moulded in one piece of plastics material comprising a latch member and a terminal receiving body, the latch member comprising a lever arm integrally joined intermediate its ends to a side wall of the body by resilient webs for pivotal movement between release and latching positions, a latch portion of the lever arm extending forwardly of the web to protrude from a mating face of the housing and a finger-engageable release portion of the lever arm extending rearwardly of the webs and overlying the entire width of the side wall, the latch portion being formed centrally with a latch eye, the webs being located in lateral planes on respective opposite sides of the latch eye and the latch eye being located in a plane displaced below a plane containing the release portion, stop means being provided on the release portion operative to prevent the release portion being pivoted towards the side wall beyond the release position, in which connector the webs are located adjacent the rear of the lever arm and the stop means comprises flanges depending from the release portion in parallel planes beyond and adjacent opposite lateral edges of the side wall, lugs being formed on respective opposite faces of the housing body which extend from the lateral edges of the side wall aligned for engagement with the respective flanges to prevent overstress.

3. An electrical connector according to claim 1 in which the latch portion is formed essentially with a latch eye and a pair of stiffening ribs extend in parallel relation along the latch portion on respective opposite sides of the eye.

4. An electrical connector according to claim 2 in which a pair of stiffening ribs extend in parallel relation along the latch portion on respective opposite sides of the eye.

* * * * *